US011668482B2

(12) United States Patent
Shin et al.

(10) Patent No.: US 11,668,482 B2
(45) Date of Patent: Jun. 6, 2023

(54) AIR CONDITIONING SYSTEM WITH PIPE SEARCH

(71) Applicant: LG ELECTRONICS INC., Seoul (KR)

(72) Inventors: Youngjoo Shin, Seoul (KR); Jaewon Lee, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 489 days.

(21) Appl. No.: 16/757,948

(22) PCT Filed: Jul. 10, 2019

(86) PCT No.: PCT/KR2019/008508
§ 371 (c)(1),
(2) Date: Apr. 21, 2020

(87) PCT Pub. No.: WO2020/013612
PCT Pub. Date: Jan. 16, 2020

(65) Prior Publication Data

US 2020/0263889 A1 Aug. 20, 2020

(30) Foreign Application Priority Data

Jul. 10, 2018 (KR) ..... 10-2018-0079772

(51) Int. Cl.
*F24F 11/63* (2018.01)
*F24F 11/30* (2018.01)
(Continued)

(52) U.S. Cl.
CPC ..... *F24F 11/30* (2018.01); *F24F 11/49* (2018.01); *F24F 11/63* (2018.01); *F24F 11/67* (2018.01);
(Continued)

(58) Field of Classification Search
CPC ..... F24F 1/00077; F24F 11/49; F24F 11/67; F24F 11/84; F24F 2140/20; F25B 13/00;
(Continued)

(56) References Cited

U.S. PATENT DOCUMENTS

2012/0285655 A1 11/2012 Lee et al.
2012/0297812 A1 11/2012 Takata et al.

FOREIGN PATENT DOCUMENTS

EP 2 927 611 10/2015
EP 2 927 612 10/2015
(Continued)

OTHER PUBLICATIONS

International Search Report (with English Translation) and Written Opinion dated Oct. 17, 2019 issued in Application No. PCT/KR2019/008508.

(Continued)

*Primary Examiner* — Jonathan Bradford
(74) *Attorney, Agent, or Firm* — KED & Associates

(57) ABSTRACT

An air conditioning system may include an outdoor unit including a compressor; at least one distributor connected to the outdoor unit and including a condenser and an evaporator that exchange heat between refrigerant and water; a plurality of heating pipes in communication with the condenser; a plurality of cooling pipes in communication with the evaporator; a plurality of fan coil units connected to the plurality of heating pipes or the plurality of cooling pipes; and a controller configured to perform a heating pipe search operation for matching a portion of the plurality of fan coil units with the plurality of heating pipes, and a cooling pipe search operation for matching another portion of the plurality of fan coil units with the plurality of cooling pipes, in parallel.

6 Claims, 8 Drawing Sheets

(51) Int. Cl.

| | |
|---|---|
| ***F24F 11/49*** | (2018.01) |
| ***F24F 11/67*** | (2018.01) |
| ***F24F 11/84*** | (2018.01) |
| *F24F 110/10* | (2018.01) |
| *F24F 140/20* | (2018.01) |
| *F25B 13/00* | (2006.01) |
| *F24F 1/0007* | (2019.01) |

(52) U.S. Cl.
CPC ..... *F24F 11/84* (2018.01); *F24F 1/00077* (2019.02); *F24F 2110/10* (2018.01); *F24F 2140/20* (2018.01); *F25B 13/00* (2013.01); *F25B 2313/003* (2013.01); *F25B 2313/007* (2013.01); *F25B 2313/0231* (2013.01); *F25B 2313/0233* (2013.01); *F25B 2313/02732* (2013.01); *F25B 2500/26* (2013.01); *F25B 2600/01* (2013.01); *F25B 2600/2513* (2013.01); *F25B 2600/2515* (2013.01); *F25B 2700/2103* (2013.01)

(58) Field of Classification Search
CPC ..... F25B 2500/26; F25B 2600/01; F25B 2600/2515; F25B 2700/2103
See application file for complete search history.

(56) References Cited

FOREIGN PATENT DOCUMENTS

| | | | |
|---|---|---|---|
| JP | 5709838 | | 4/2015 |
| KR | 10-2008-0044081 | | 5/2008 |
| KR | 20110073707 A | * | 6/2011 |
| KR | 10-1204443 | | 11/2012 |
| KR | 10-2014-0109037 | | 9/2014 |
| KR | 10-2017-0090117 | | 8/2017 |
| KR | 10-2017-0090118 | | 8/2017 |
| KR | 10-1819745 | | 1/2018 |
| WO | WO 2014-083683 | | 1/2017 |

OTHER PUBLICATIONS

European Search Report issued in Application No. 19833492.2 dated Jun. 20, 2022.
Korean Office Action issued in Application No. 10-2018-0079772 dated Jul. 12, 2022.

* cited by examiner

AIR CONDITIONING SYSTEM WITH PIPE SEARCH

CROSS-REFERENCE TO RELATED PATENT APPLICATIONS

This application is a U.S. National Stage Application under 35 U.S.C. § 371, of PCT Application NO. PCT/KR2019/008508, filed Jul. 10, 2019, which claims priority to Korean Patent Application No. 10-2018-0079772, filed Jul. 10, 2018, whose entire disclosures are hereby incorporated by reference.

TECHNICAL FIELD

The present disclosure relates to an air conditioning system, and more particularly, to an air conditioning system including a fan coil unit.

BACKGROUND ART

In general, an air conditioner is a device for cooling or heating an indoor space such as a living space, a restaurant, an office or the like. To efficiently cool or heat an indoor space which is divided into a plurality of rooms, a simultaneous cooling and heating type multi air conditioner capable of cooling or heating each room has been continuously developed.

In particular, a fan coil unit (FCU) receives cold water or hot water from a freezer or a boiler during cooling and heating of a building, cools or heats surrounding air by allowing the cold or hot water to pass through a heat exchanger, and then discharge heat-exchanged air to a room according to the driving of a blower to achieve cooling and heating.

On the other hand, the simultaneous cooling and heating type multi air conditioner is provided with a distributor between the outdoor unit and the indoor unit to adjust refrigerant supplied to the indoor unit to allow the indoor unit to operate the cooling and heating operation, and when the pipe connection state of the distributor and a plurality of indoor devices are incorrect, there is a malfunction problem that the indoor unit which should operate cooling operation may perform the heating operation is performed or a malfunction problem may be caused, another indoor device operates, or the like. In order to solve this problem, a method of searching for connection pipes between the distributor and the plurality of indoor units has been proposed.

In the case of the prior document KR 10-2017-0090117 A, there is disclosed a method of searching for a plurality of indoor units in a distributor and further searching for an indoor unit connected to a pipe. However, unlike the refrigerant distributor, since the fan coil unit uses a water channel, it is difficult to determine a temperature change when hot water and cold water are mixed in the water channel, and it is difficult to apply the technique of the prior art to the fan coil unit.

Further, in the case of the prior document KR 10-2014-0109037 A, there is disclosed a method of first searching for an indoor unit not connected to a distributor and then matching the indoor unit connected to the distributor with a pipe. However, since the heat exchanger and the fan coil unit in the distributor use a closed channel and all the fan coil units are connected to the distributor, it is difficult to apply the technique of the prior art to the fan coil unit.

DISCLOSURE

Technical Problem

An object to be achieved by the present disclosure is to provide an air conditioning system capable of quickly performing search for a pipe connected to each fan coil unit.

Another object to be achieved by the present disclosure is to provide an air conditioning system capable of initiating flow control of each fan coil unit at an optimized set point thereby quickly performing heating and cooling operation compared to the prior art.

Technical Solution

In the air conditioning system according to the embodiment of the present disclosure, the controller performs a heating pipe search operation and a cooling pipe search operation in parallel to considerably shorten time required to search for a heating/cooling pipe connected to each fan coil unit.

Specifically, an air conditioning system according to an embodiment of the present disclosure may include an outdoor unit including a compressor; at least one distributor connected to the outdoor unit and including a condenser and an evaporator that exchange heat between refrigerant and water; a plurality of heating pipes in communication with the condenser; a plurality of cooling pipes in communication with the evaporator; a plurality of fan coil units connected to the heating pipes or the cooling pipes; and a controller configured to perform a heating pipe search operation for respectively matching a portion of the plurality of fan coil units with the plurality of heating pipes, and a cooling pipe search operation for respectively matching another portion of the plurality of fan coil units with the plurality of cooling pipes, in parallel.

The controller may turn on the compressor when a pipe search command is input to an input unit, and initiate the heating pipe search operation and the cooling pipe search operation when a predetermined set time has elapsed after the compressor is turned on or when a high pressure of the compressor reaches a predetermined set pressure or more.

The air conditioning system may further include a plurality of temperature sensors respectively provided in the plurality of fan coil units; and a storage unit configured to store initial sensing temperatures of the plurality of temperature sensors before the heating pipe search operation and the cooling pipe search operation are performed.

The air conditioning system may further include a plurality of temperature sensors respectively provided in the plurality of fan coil units; a plurality of heating flow valves respectively installed in the plurality of heating pipes; and a plurality of cooling flow valves respectively installed in the plurality of cooling pipes. The controller may, after any one of the plurality of heating flow valves is opened, match a fan coil unit provided with a temperature sensor of which a sensing temperature rises by a set temperature or more among the plurality of temperature sensors with a heating pipe provided with the any one heating flow valve, and after any one of the plurality of cooling flow valves is opened, match a fan coil unit provided with a temperature sensor of which a sensing temperature drops by a set temperature or more among the plurality of temperature sensors with a cooling pipe provided with the any one cooling flow valve.

The air conditioning system may further include a first timer configured to measure search times respectively required for matching of the plurality of heating pipes; a second timer configured to measure search times respectively required for matching of the plurality of cooling pipes; and a storage unit configured to store the search times measured by the first timer and the second timer.

The controller may the controller may control an initial opening degree of a heating flow valve installed in a heating pipe with a relatively long search time to be larger than an initial opening degree of a heating flow valve installed in a heating pipe with a relatively short search time when operation of a fan coil unit connected to the heating pipe is initiated after the heating pipe search operation and the cooling pipe search operation are completed, and control an initial opening degree of a cooling flow valve installed in a cooling pipe with a relatively long search time to be larger than an initial opening degree of a cooling flow valve installed in a cooling pipe with a relatively short search time when operation of a fan coil unit connected to the cooling pipe is initiated after the heating pipe search operation and the cooling pipe search operation are completed.

The air conditioning system according to the embodiment of the present disclosure may perform the flow control of each fan coil unit at the optimized set point by determining the initial opening degree of each flow valve in accordance with the search time of each connection pipe, Specifically, an air conditioning system according to an embodiment of the present disclosure may include an outdoor unit including a compressor; at least one distributor connected to the outdoor unit and including a condenser and an evaporator that exchange heat between refrigerant and water; a plurality of connection pipes in communication with the condenser or evaporator; a plurality of flow valves respectively installed in the plurality of connection pipes; a plurality of fan coil units connected to the connection pipes; a controller configured to perform a pipe search operation for matching the plurality of connection pipes with the plurality of fan coil units, respectively; a timer configured to measure search times respectively required for matching of the plurality of connection pipes; and a storage unit configured to store the search times. The controller may control an initial opening degree of a flow valve installed in a connection pipe with a relatively long search time to be larger than an initial opening degree of a flow valve installed in a connection pipe with a relatively short search time when operation of the fan coil units is initiated after the pipe search operation is completed.

The controller may fully open an initial opening degree of a flow valve installed in a connection pipe with a longest search time among the plurality of flow valves when the operation of the fan coil units is initiated after the pipe search operation is completed.

Advantageous Effects

According to the preferred embodiment of the present disclosure, the heating pipe search operation and the cooling pipe search operation are performed in parallel, thus considerably shortening a time required to search for the heating/cooling pipes connected to each fan coil unit.

In addition, it is possible to perform the flow control of each fan coil unit at the optimized set point by determining the initial opening degree of each flow valve in accordance with the search time of each connection pipe, As a result, it is possible to perform the cooling and heating of a room in which each fan coil unit is installed more quickly compared to the prior art.

In addition, it is possible to prevent excessive or insufficient heating and cooling performance of each fan coil unit due to the optimized set point and improves the overall efficiency of the air conditioning system.

In addition, since the search time is measured at each pipe search operation, there is an advantage that a separate time measurement for optimizing the set point is unnecessary.

MODE FOR INVENTION

Hereinafter, specific embodiments of the present disclosure will be described in detail with reference to the drawings.

Figure 1:
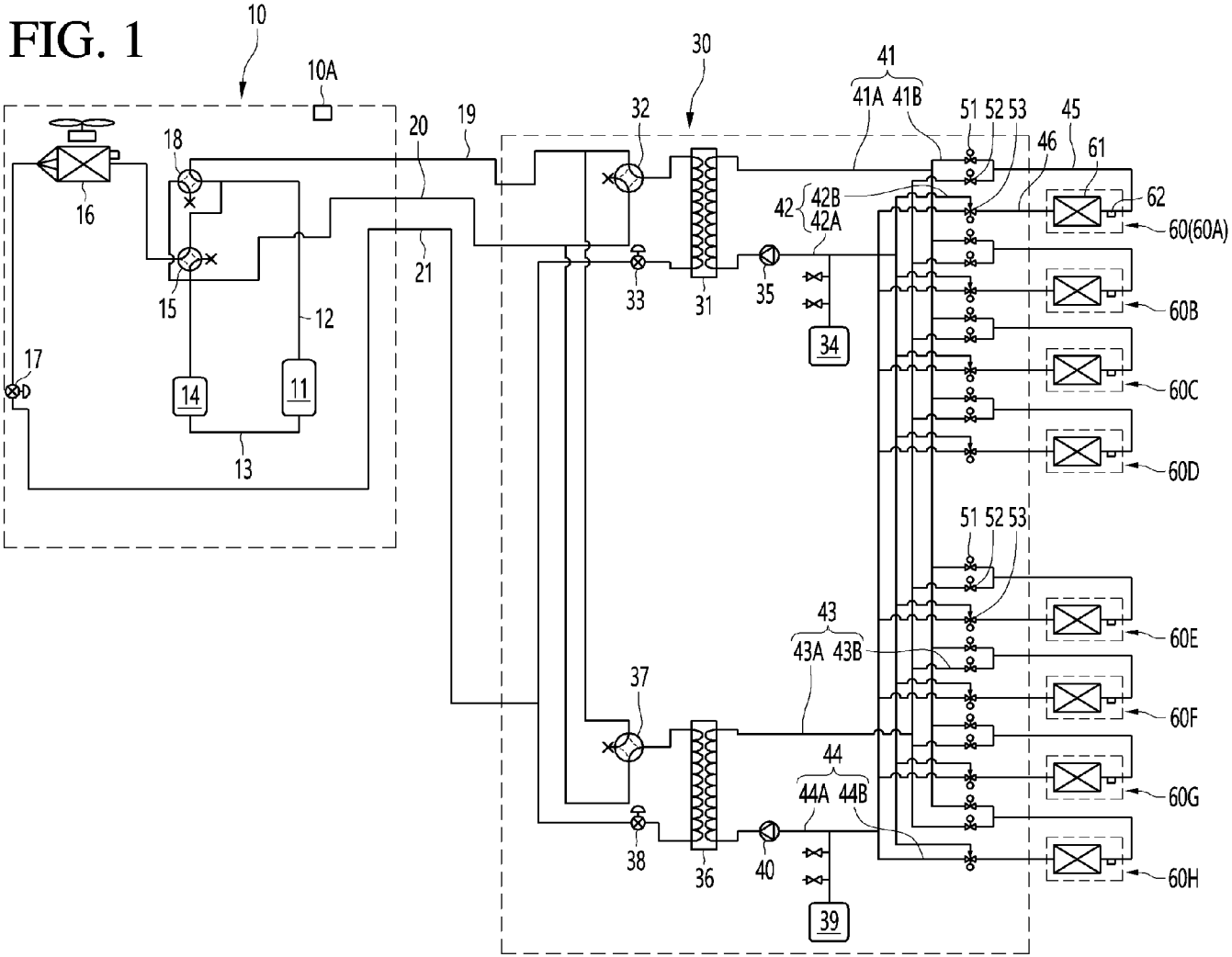
FIG. 1 is a schematic configuration diagram of an air conditioning system according to an embodiment of the present disclosure.

FIG. 1 is a schematic configuration diagram of an air conditioning system according to an embodiment of the present disclosure.

An air conditioning system according to an embodiment of the present disclosure may be a switchable or simultaneous type air conditioner.

The air conditioning system may include an outdoor unit 10, at least one distributor 30 connected to the outdoor unit 10, and a plurality of fan coil units 60 connected to the distributor 30.

The air conditioning system may control the outdoor unit 10 with a cooling-oriented operation or a heating-oriented operation according to a cooling load and a heating load required by the plurality of fan coil units 60. Of course, the air conditioning system is capable of performing an all-indoor unit cooling operation or an all-indoor unit heating operation.

The outdoor unit 10 may be connected to the distributor by a high-pressure pipe 19, a low-pressure pipe 20, and a liquid pipe 21.

The outdoor unit 10 may include a compressor 11, an outdoor heat exchanger 16, a first outdoor four-way valve 15, a second outdoor four-way valve 18, and an outdoor expansion mechanism 17.

The compressor 11 may be an inverter compressor whose operating frequency is controlled. A suction pipe 13 and a discharge pipe 12 may be connected to the compressor 11. The refrigerant sucked into the compressor 11 through the suction pipe 13 may be compressed by the compressor 11 and discharged to the discharge pipe 12.

An accumulator 14 may be installed in the suction pipe 13 to separate gaseous refrigerant from liquid refrigerant, and the gaseous refrigerant may be sucked into the compressor 11.

The outdoor heat exchanger 16 may exchange heat with air blown by an outdoor fan and condense or evaporate the refrigerant. The outdoor fan may be included in the outdoor unit 10.

The liquid pipe 21 may be connected to the outdoor heat exchanger 16. In more detail, one side of the outdoor heat exchanger 16 may communicate with the first outdoor four-way valve 15 and the other side may be connected to the liquid pipe 21 with respect to a flow path of the refrigerant.

The first outdoor four-way valve 15 may selectively communicate the outdoor heat exchanger 16 with the suction pipe 13 or the discharge pipe 12. The second outdoor four-way valve 18 may selectively communicate the high-pressure pipe 19 with the suction pipe 13 or the discharge pipe 12.

The outdoor unit 10 may be provided with an outdoor air temperature sensor 10A that senses a temperature of outdoor air.

On the other hand, each fan coil unit 60 may perform cooling or heating by water heat-exchanged with the refrigerant 30 in the distributor and distributed. A plurality of fan coil units 60 may be provided.

Each of the fan coil units 60 may be connected to the distributor 30 by an inlet pipe 45 and an outlet pipe 46. The heated or cooled water that has heat-exchanged in the distributor 30 may flow to the fan coil unit 60 through the inlet pipe 45, and water that has performed heating or cooling in the fan coil unit 60 may flow to the distributor 30 via the outlet pipe 46.

Each of the fan coil units 60 may include a fan coil heat exchanger 61. Water heated or cooled by being heat-exchanged with the refrigerant in the distributor 30 may pass through the fan coil heat exchanger 61, and air blown by an indoor fan (not shown) included in the fan coil unit 60 may be heat-exchanged with the water in the fan coil heat exchanger 61 to perform heating or cooling of rooms.

The fan coil heat exchanger 61 may be connected to the inlet pipe 45 and the outlet pipe 46.

In addition, each of the fan coil units 60 may be provided with a temperature sensor 62, and the temperature sensor 62 may sense a temperature of the water passing through the fan coil unit 60. The temperature sensor 62 may be preferably installed at the inlet side or the inlet pipe 45 of the fan coil heat exchanger 61.

In addition, each of the fan coil units 60 may be provided with a communication unit (not shown) capable of communicating with the distributor 30.

On the other hand, the distributor 30 may heat-exchange the refrigerant introduced from the outdoor unit 10 with the water, and distribute the heat-exchanged water to the fan coil units 60.

The distributor 30 may include heat exchangers 31 and 36, four-way valves 32 and 37, expansion mechanisms 33 and 38, flow valves 51 and 52, and a three-way valve 53.

The distributor 30 may include a plurality of heat exchangers 31 and 36 that exchange heat between refrigerant and water. Each of the heat exchangers 31 and 36 may function as an evaporator or a condenser depending on the heating and cooling loads of the fan coil units 60. The refrigerant may be condensed in the heat exchanger 31 or 36 when water is heated in the heat exchanger 31 or 36, and the refrigerant may be evaporated in the heat exchanger 31 or 36 when the water is cooled in the heat exchanger 31 or 36.

With respect to a flow direction of the refrigerant, one side of the heat exchanger 31 or 36 may selectively communicate with the high-pressure pipe 19 or the low-pressure pipe 20 by the four-way valve 32 or 37. More specifically, when the heat exchanger 31 or 36 is in communication with the high-pressure pipe 19 by the four-way valve 32 or 37, the heat exchanger 31 or 36 may function as a condenser that condenses the refrigerant and heats the water and when the heat exchanger 31 or 36 is in communication with the low-pressure engine 20 by the four-way valve 32 or 37 may function as an evaporator that evaporates the refrigerant and cools the water.

The other side of the heat exchanger 31 or 36 may be in communication with the liquid pipe 21 in which the expansion mechanisms 33 are 38 are installed. The expansion mechanism 33 or 38 may be fully opened when the heat exchangers 31 and 36 function as condensers, and the expansion mechanisms 33 and 38 may be controlled to be opened at a preset opening degree when the heat exchangers 31 and 36 function as evaporators.

In addition, inlet pipes 42 and 44 and outlet pipes 41 and 43 may be respectively connected to the heat exchangers 31 and 36. Water introduced into the heat exchangers 31 and 36 through the inlet pipes 42 and 44 may be heat-exchanged with the refrigerant in the heat exchangers 31 and 36 and discharged into the outlet pipes 41 and 43.

Water pumps 35 and 40 may be installed in the inlet pipes 42 and 44, and the water pumps 35 and 40 may circulate water between the heat exchanger 31 and 36 and the fan coil unit 60.

In addition, water tanks 34 and 39 may be connected to the inlet pipes 42 and 44, and water in the water tanks 34 and 39 may be sucked into the inlet pipes 42 and 44 by the water pumps 35 and 40. A valve may be provided between the water tanks 34 or 39 and the inlet pipes 42 or 44 to control the water supply to the water tanks 34 or 39.

A plurality of flow valves 51 and 52 and the three-way valve 53 may distribute the water heat-exchanged in each of the heat exchangers 31 and 36 to the fan coil units 60.

The flow valves 51 and 52 may communicate or disconnect the inlet pipe 45 of each of the fan coil units 60 with or from the outlet pipe 41 or 43 of the heat exchanger 31 or 36.

The three-way valve 53 may selectively communicate the outlet pipe 46 of each of the fan coil units 60 with any one of the inlet pipes 42 and 44 of each of the heat exchangers 31 and 36.

Hereinafter, a description will be given by taking, as an example, a case in which the heat exchangers 31 and 36 of the distributor 30 include a first heat exchanger 31 and a second heat exchanger 36, and eight fan coil units 60 are connected to the distributor 30.

The flow valves 51 and 52 may include a first flow valve 51 that communicate or disconnect the inlet pipe 45 of each fan coil unit 60 with or from the first outlet pipe 41 of the first heat exchanger 31 and a second flow valve 51 that communicate or disconnect the outlet pipe 46 of each fan coil unit 60 with or from the second outlet pipe 43 of the second heat exchanger 36.

In addition, the three-way valve 53 may selectively communicate the outlet pipe 46 of each fan coil unit 60 with one the first inlet pipe 42 of the first heat exchanger 31 and the second inlet pipe 44 of the second heat exchanger 36.

More specifically, the inlet pipe 45 connected to the fan coil unit 60 may be in communication with the first outlet pipe 41 connected to the first heat exchanger 31 or the second outlet pipe 43 connected to the second heat exchanger 36.

The first outlet pipe 41 may include a first common outlet pipe 41A connected to the first heat exchanger 31 and first branch outlet pipes 41B which are branches from the first common outlet pipe 41A, and of which the number is the same number as the number of fan coil units 60. Each first branch outlet pipe 41B may be in communication with the inlet pipe 45 of each fan coil unit 60, and each first branch outlet pipe 41B may be provided with a first flow valve 51. That is, eight first branch water outlet pipes 41B and eight first flow valves 51 may be provided.

The second outlet pipe 43 may include a second common outlet pipe 43A connected to the second heat exchanger 36 and second branch outlet pipes 41B which are branches from the second common outlet pipe 43A, and of which the number is the same number as the number of fan coil units 60. Each second branch outlet pipe 43B may be in communication with the inlet pipe 45 of each fan coil unit 60, and each second branch outlet pipe 43B may be provided with a second flow valve 52. That is, eight second branch outlet pipes 43B and eight second flow valves 51 may be provided.

In addition, the outlet pipe 46 connected to the fan coil unit 60 may be in communication with the first inlet pipe 42 connected to the first heat exchanger 31 or the second inlet pipe 44 connected to the second heat exchanger 36.

The first inlet pipe 42 may include a first common inlet pipe 42A connected to the first heat exchanger 31 and first branch inlet pipes 42B which are branches from the first common inlet pipe 42A, and of which the number is the same number as the number of fan coil units 60. That is, eight first branch inlet pipes 42B may be provided. Each of the first branch inlet pipes 42B may be selectively in communication with the outlet pipe 46 of each of the fan coil units 60 by the three-way valve 53.

The first water pump 35 may be installed in the first inlet pipe 42. In more detail, the first water pump 35 may be installed in the first common inlet pipe 42A.

The second inlet pipe 44 may include a second common inlet pipe 44A connected to the second heat exchanger 36 and second branch inlet pipes 44B which are branches from the second common inlet pipe 44A, and of which the number is the same number as the number of fan coil units 60. That is, eight second branch inlet pipes 44B may be provided. Each of the second branch inlet pipes 44B may be selectively in communication with the outlet pipe 46 of each of the fan coil units 60 by the three-way valve 53.

The second water pump 40 may be installed in the second inlet pipe 44. In more detail, the second water pump 40 may be installed in the second common inlet pipe 44A.

Eight three-way valves 53 may be provided. That is, the first flow valve 51, the second flow valve 52, and the three-way valve 53 may be provided to correspond to the fan coil units 60 one by one.

In summary, each of the first flow valves 51 may control the flow of water introduced to each of the fan coil units 60 from the first heat exchanger 31, and each of the second flow valves 52 may control the flow of water introduced to each of the fan coil units 60 from the second heat exchanger 36.

One of the first flow valve 51 and the second flow valve 52 corresponding to any one of the fan coil units 60A may be opened and the other may be closed. For example, when the first flow valve 51 is opened and the second flow valve 52 is closed, the three-way valve 53 may communicate the any one of the fan coil units 60A with the first heat exchanger 31. On the contrary, when the first flow valve 51 is opened and the second flow valve 52 is closed, the three-way valve 53 may communicate the one fan coil unit 60A with the second heat exchanger 36.

Therefore, according to the control of the first flow valve 51, the second flow valve 52, and the three-way valve 53 corresponding to the one fan coil unit 60A, it is possible to determine which of the first heat exchanger 31 and the second heat exchanger 36 the one fan coil unit 60A is be in communication with.

On the other hand, the distributor 30 may be provided with a communication unit (not shown) capable of communicating with the fan coil units 60.

Figure 2:
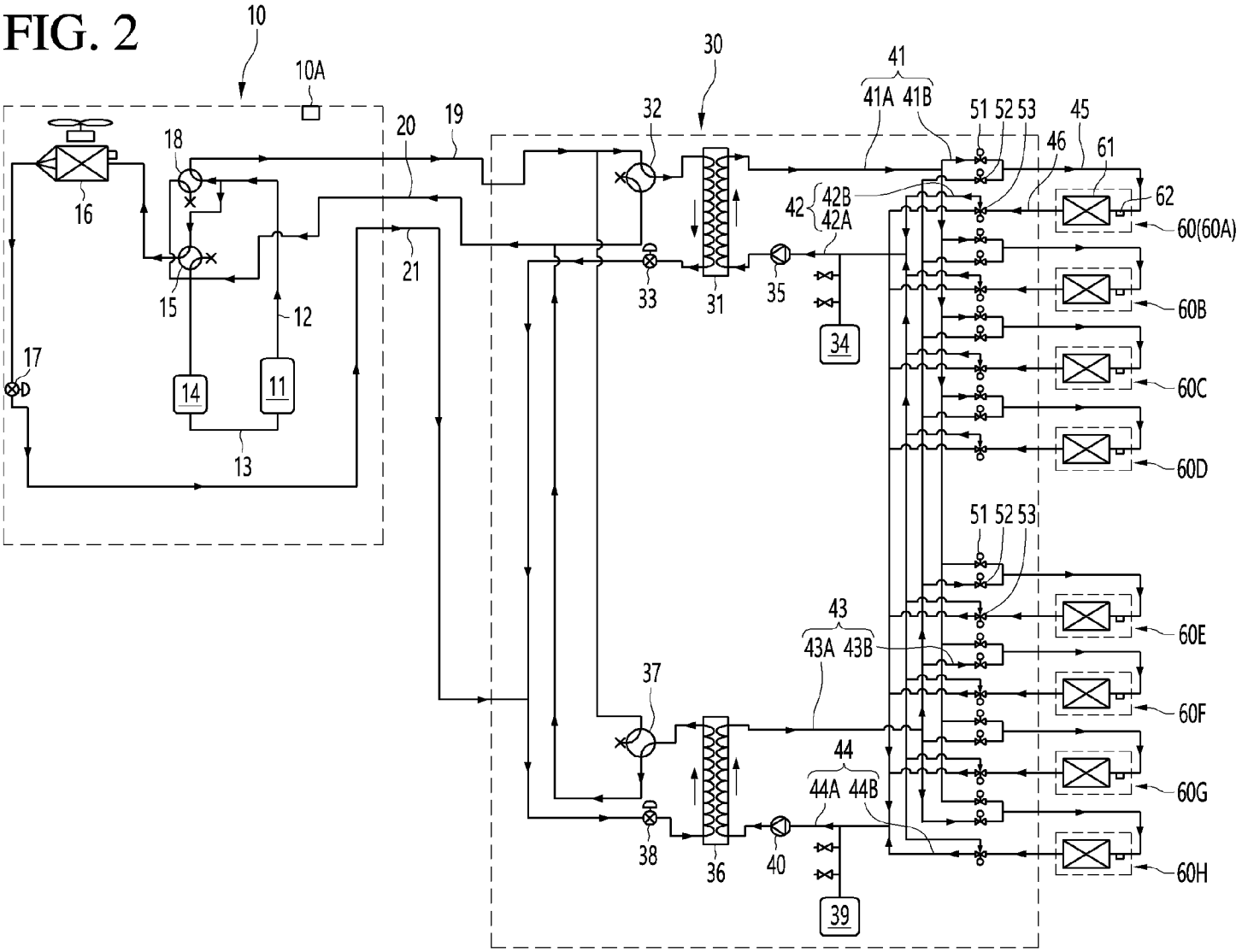
FIG. 2 is a view showing flow of refrigerant and water when the refrigerant is condensed in an outdoor unit.
Figure 3:
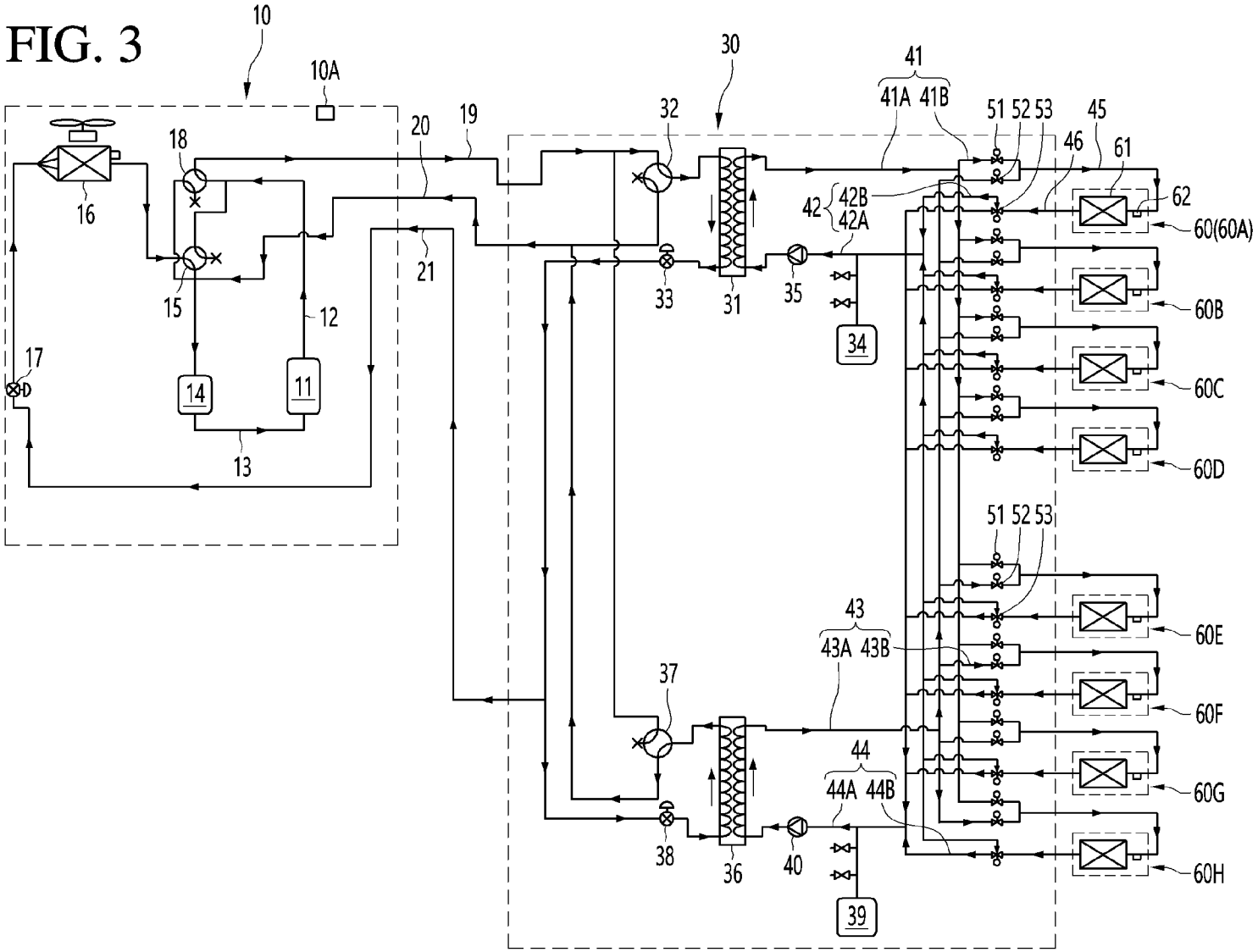
FIG. 3 is a view showing flow of refrigerant and water when the refrigerant is evaporated in an outdoor unit.

FIG. 2 is a view showing flow of refrigerant and water when the refrigerant is condensed in an outdoor unit, and FIG. 3 is a view showing flow of refrigerant and water when the refrigerant is evaporated in an outdoor unit.

Hereinafter, for convenience of description, a description will be given as taking, as an example, a case in which refrigerant is condensed and water is heated in the first heat exchanger 31 and refrigerant is evaporated and water is cooled in the second heat exchanger 36. Thus, the first heat exchanger 31 may be referred to as the condenser 31 and the second heat exchanger 36 may be referred to as the evaporator 36. In addition, the first flow valve 51 may be referred to as a heating flow valve 51, and the second flow valve 52 may be referred to as a cooling flow valve 52.

In this case, the first expansion mechanism 33 connected to the condenser 31 may be fully opened, and the first four-way valve 32 connected to the condenser may communicate the condenser 31 with the high-pressure pipe 19. In addition, the second expansion mechanism 38 connected to the evaporator 36 may be controlled to be opened at a preset opening degree, and the second four-way valve 37 connected to the evaporator 36 may communicate the evaporator 36 with the low-pressure pipe 20.

Some of the plurality of fan coil units 60 may be heated by water heated in the condenser 31, and other some may be cooled by water cooled in the evaporator 36. Thus, each of the fan coil units 60A, 60B, 60C and 60D in communication with the condenser 31 may be referred to as a heating fan coil unit, and each of the fan coil units 60E, 60F, 60G and 60H in communication with the evaporator 36 may be referred to as a cooling fan coil unit.

The heating flow valve 51 corresponding to the heating fan coil units 60A, 60B, 60C and 60D may be opened, the cooling flow valve 52 may be be closed, and the three-way valve 53 may communicate the fan coil units 60A, 60B, 60C, and 60D with the condenser 31. In this case, a first branch discharge pipe 41B in which the heating flow valve 51 which is opened is installed may be referred to as a heating pipe, and guide hot water heated in the condenser 31 to the inlet pipe 45 connected to the heating fan coil units 60A, 60B, 60C and 60D.

As a result, the water heated in the condenser 31 and flowing into the first water outlet pipe 41 may pass through the heating flow valve 51 and flow into the heating fan coil units 60A, 60B, 60C and 60D to perform indoor heating. Thereafter, the heating is performed in the heating fan coil units 60A, 60B, 60C and 60D, and water of which the temperature drops may flow to the condenser 31 through the first inlet pipe 42 by passing through the three-way valve 53 to be heated and circulated again.

The heating flow valve 51 corresponding to the cooling fan coil units 60E, 60F, 60G and 60H may be closed, the cooling flow valve 52 may be opened, and the three-way valve 53 may communicate the cooling fan coil units 60E, 60F, 60G and 60H with the evaporator 36. In this case, the second branch water outlet pipe 43B in which the cooling flow valve 52 which is opened is installed may be referred to as a cooling pipe, and the cooling pipe 43B may guide cooling water cooled by the evaporator 36 to the cooling fan coil units 60E, 60F, 60G and 60H.

As a result, the water cooled in the evaporator 36 and flowing to the cooling water outlet pipe 43 may pass through the second flow valve 52 and flow to the cooling fan coil units 60E, 60F, 60G and 60H to perform indoor cooling. Thereafter, the cooling is performed in the cooling fan coil units 60E, 60F, 60G and 60H, and water of which the temperature raises may flow to the condenser 31 through the first inlet pipe 42 by passing through the three-way valve 53 to be cooled and circulated again.

On the other hand, when a cooling load required by the cooling fan coil units 60E, 60F, 60G and 60H is greater than a heating load required by the heating fan coil units 60A, 60B, 60C and 60D, the air conditioning system may cope with the insufficient heating load in the outdoor unit 10. A description will be given with reference to FIG. 2.

A part of the refrigerant discharged from the compressor 11 to the discharge tube 12 may flow to the outdoor heat exchanger 16 by passing through the first outdoor four-way valve 15 and, and the other part may flow to the high-pressure pipe 19 by passing through the second outdoor four-way valve 18.

The refrigerant flowing to the outdoor heat exchanger 18 may flow into the liquid pipe 21 after being condensed in the outdoor heat exchanger 18.

The refrigerant flowing into the high-pressure pipe 19 may flow to the condenser 31 by passing through the first four-way valve 32 and may be condensed in the condenser 31 and then flow to the liquid pipe 21.

The refrigerant condensed in the outdoor heat exchanger 16 and the condenser 31 may be combined and flow in the liquid pipe 21. The refrigerant in the liquid pipe 21 may expand by passing through the expansion mechanism 38 adjacent to the evaporator 36 and be evaporated while cooling the water in the evaporator 36. Thereafter, the refrigerant may flow to the low-pressure pipe 20 by passing through the second four-way valve 37 and may be guided to the suction pipe 13 through the low-pressure pipe 20 and sucked into the compressor 11. The compressor 11 may again compress the refrigerant and discharges the refrigerant to the discharge tube 12 to achieve circulation of the refrigerant.

On the other hand, when a heating load required by the heating fan coil units 60A, 60B, 60C and 60D is greater than a cooling load required by the cooling fan coil units 60E, 60F, 60G and 60H, the air conditioning system may cope with an insufficient cooling load in the outdoor unit 10. A description will be given with reference to FIG. 3.

The refrigerant discharged from the compressor 11 to the discharge tube 12 may flow through the second outdoor four-way valve 18 to the high-pressure pipe 19.

The refrigerant flowing into the high-pressure pipe 19 may flow to the condenser 31 by passing through the first four-way valve 32 and may be condensed in the condenser 31 and then flow to the liquid pipe 21.

A part of refrigerant flowing into the liquid pipe 21 may flow to the side of the evaporator 36, and the other part may flow to the side of the outdoor unit 10.

The refrigerant flowing from the liquid pipe 21 to the side of the evaporator 36 may expand by passing through the expansion mechanism 38 and be evaporated while cooling water in the evaporator 36. The evaporated refrigerant may flow into the low-pressure pipe 20 through the second four-way valve 37, and may flow into the suction pipe 13 along the low-pressure pipe 20.

The refrigerant flowing from the liquid pipe 21 to the outdoor unit 10 may expand while passing through the outdoor expansion mechanism 17 and be evaporated in the outdoor heat exchanger 16. The evaporated refrigerant may flow through the first outdoor four-way valve 15 to the suction pipe 13.

The refrigerant evaporated in the evaporator 36 and the refrigerant evaporated in the outdoor heat exchanger 16 may be combined and flow in the suction pipe 13. The refrigerant in the suction tube 13 may be sucked into the compressor 11, and the compressor 11 may compress the refrigerant again and discharge the refrigerant to the discharge tube 12 to allow the refrigerant to be circulated.

Figure 4:
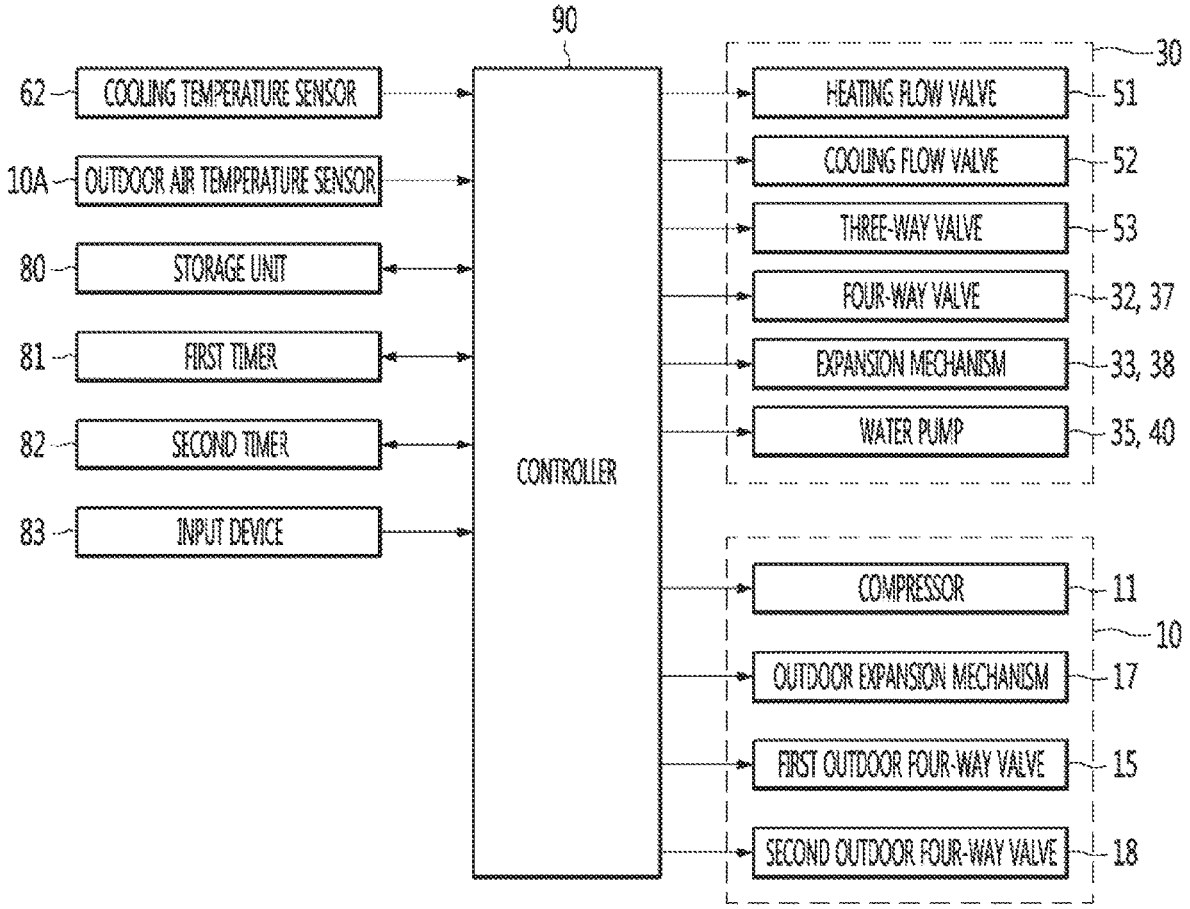
FIG. 4 is a control block diagram of an air conditioning system according to an embodiment of the present disclosure.

FIG. 4 is a control block diagram of an air conditioning system according to an embodiment of the present disclosure.

An air conditioning system according to an embodiment of the present disclosure may further include a controller 90. The controller 90 may control overall operation of the air conditioning system.

The controller 90 may be provided in at least one of the outdoor unit 10, the distributor 30, and the fan coil unit, or may be included in a central control system of a building or the like in which an air conditioning system is installed.

The controller 90 may receive the sensing temperatures of the plurality of temperature sensors 62 provided in the fan coil units 60, respectively.

The controller 90 may receive a sensing temperature of the outdoor air temperature sensor 10A provided in the outdoor unit 10.

The controller 90 may control the distributor 30.

In more detail, the controller 90 may control the opening degrees of the plurality of heating flow valves 51 to control the amount of hot water heated in the condenser 31 to be introduced into each of the fan coil units 60. In addition, the controller 90 may control the opening degrees of the plurality of cooling flow valves 52 to control the amount of cold water cooled in the evaporator to be introduced into each of the fan coil units 60. In addition, the controller 90 may control the three-way valve 53 to selectively communicate the outlet pipe 46 connected to the fan coil unit 40 with the first inlet pipe 42 connected to the condenser 31 or the second inlet pipe 44 connected to the evaporator 36. In addition, the controller 90 may control the four-way valves 32 and 37 and the expansion mechanisms 33 and 38 to enable each of the first and second heat exchangers 31 and 36 to function as a condenser or an evaporator. In addition, the controller 90 may control the turning on and off and the operating frequency of the water pumps 35 and 40.

The controller 90 may control the outdoor unit 10.

In more detail, the controller 90 may control the turning on and off and operating frequency of the compressor 11. In addition, the controller 90 may control the opening degree of the outdoor expansion mechanism 17. In addition, the controller 90 may selectively communicate the outdoor heat exchanger 16 with the suction pipe 13 or the discharge pipe 12 by controlling the first outdoor four-way valve 15. In addition, the controller 90 may selectively communicate the high-pressure pipe 19 with the suction pipe 13 or the discharge pipe 12 by controlling the second outdoor four-way valve 18.

On the other hand, the air conditioning system according to an embodiment of the present disclosure may further include a storage unit 80, a first timer 81, a second timer 82, and an input unit 83.

The controller 90 may store information related to the air conditioning system in the storage unit 80 or control the air conditioning system using information stored in the storage unit 80.

The controller 90 may operate or stop the first and second timers 81 and 82, and receive time measured by the first and second timers 81 and 82 and store the time in the storage unit 80.

The controller 90 may receive a command input through the input unit 83. The configuration of the input unit 83 is not limited.

Figure 5:
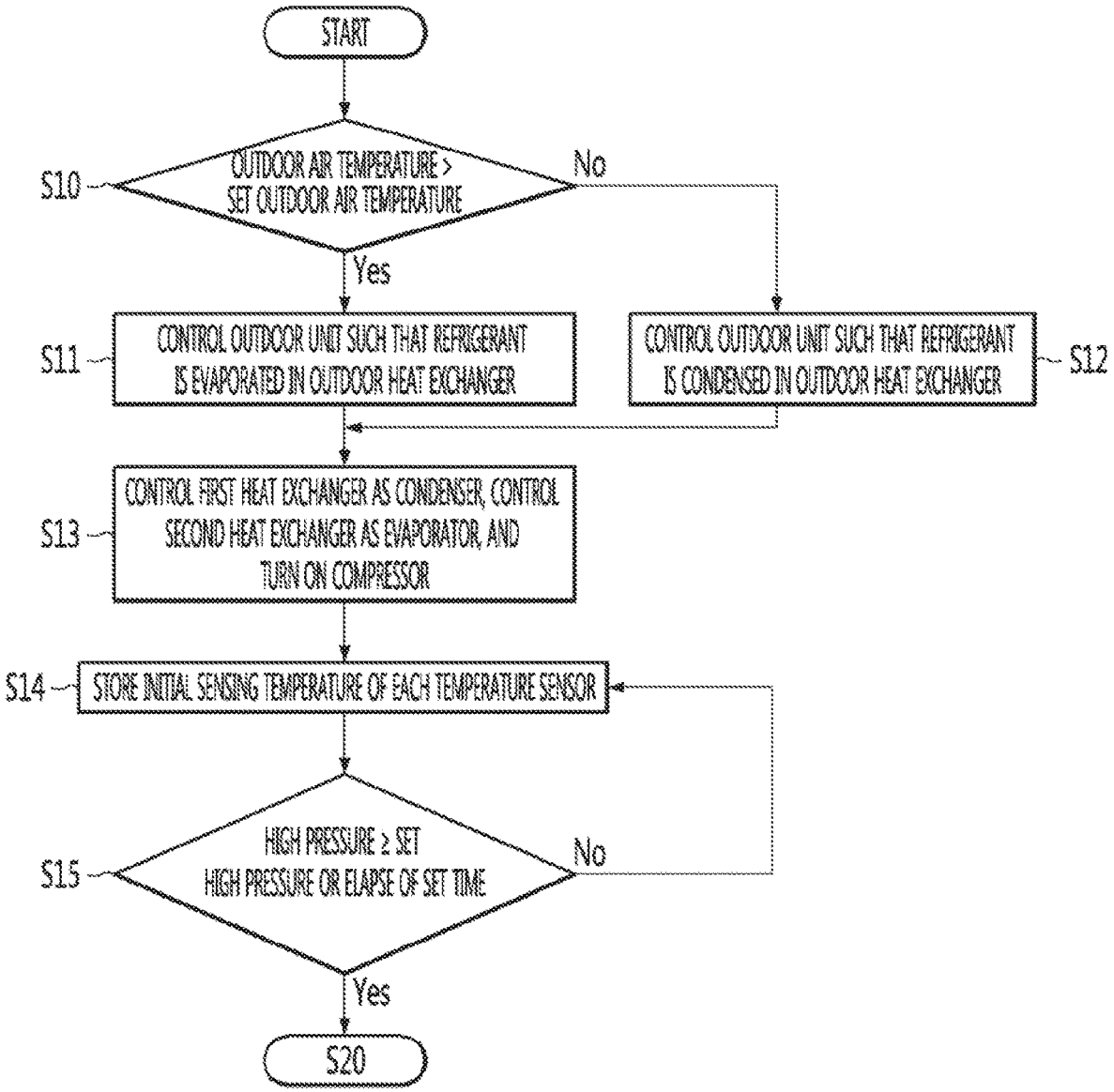
FIG. 5 is a flowchart illustrating a control sequence of a pipe search preparation operation of an air conditioning system according to an embodiment of the present disclosure.

FIG. 5 is a flowchart illustrating a control sequence of a pipe search preparation operation of an air conditioning system according to an embodiment of the present disclosure.

When a pipe search command is input to the input unit 83, the controller 90 may preferentially perform a pipe search preparation operation before pipe search operation S20.

In more detail, when the pipe search command is input to the input unit 83, the controller 90 may determine whether an outdoor air temperature sensed by the outdoor air temperature sensor 10A is higher than a predetermined set outdoor air temperature To (e.g., 15 degrees Celsius) (S10).

When the outdoor air temperature is higher than the set outdoor air temperature To, evaporation of refrigerant may occur actively in the outdoor heat exchanger 16, and the controller 90 may control the outdoor unit 10 such that the refrigerant is evaporated in the outdoor heat exchanger 16 as described with reference to FIG. 3 (S11). In more detail, the controller 90 may control the first four-way valve 15 to communicate the outdoor heat exchanger 16 with the suction pipe 13.

On the other hand, when the outdoor air temperature is lower than or equal to the set outdoor air temperature To, condensation of refrigerant may occur actively in the outdoor heat exchanger 16, and the controller 90 may control the outdoor unit 10 such that the refrigerant is condensed in the outdoor heat exchanger 16 as described with reference to FIG. 2 (S12). In more detail, the controller 90 may control the first four-way valve 15 to communicate the outdoor heat exchanger 16 with the discharge tube 12.

As a result, the efficiency of the air conditioning system may be improved when the pipe search operation S20 is performed.

Thereafter, the controller 90 may control the first heat exchanger 31 as a condenser, control the second heat exchanger 36 as an evaporator, and turn on the compressor 11 (S13). In more detail, the controller 90 may control the first four-way valve 32 to communicate the first heat exchanger 31 with the high-pressure pipe 19 and fully open the first expansion mechanism 33. In addition, the controller 90 may control the second four-way valve 37 to communicate the second heat exchanger 36 with the low-pressure pipe 20, and control the second expansion mechanism 38 to be opened at a predetermined opening degree.

In addition, the controller 90 may store an initial sensing temperature Ti of each of the temperature sensors 62 respectively provided in the plurality of fan coil units 60 in the storage unit 80 (S14). In this case, hot or cold water may not flow in each of the fan coil units 60.

Thereafter, when the high pressure of the compressor 11 increases higher than a predetermined set high pressure or when a set time has elapsed after the compressor 11 is turned on, the controller 90 may perform a pipe search operation S20 (S15). The high pressure of the compressor 11 may be measured by a high pressure sensor (not shown) provided in the discharge tube 12.

Figure 6:
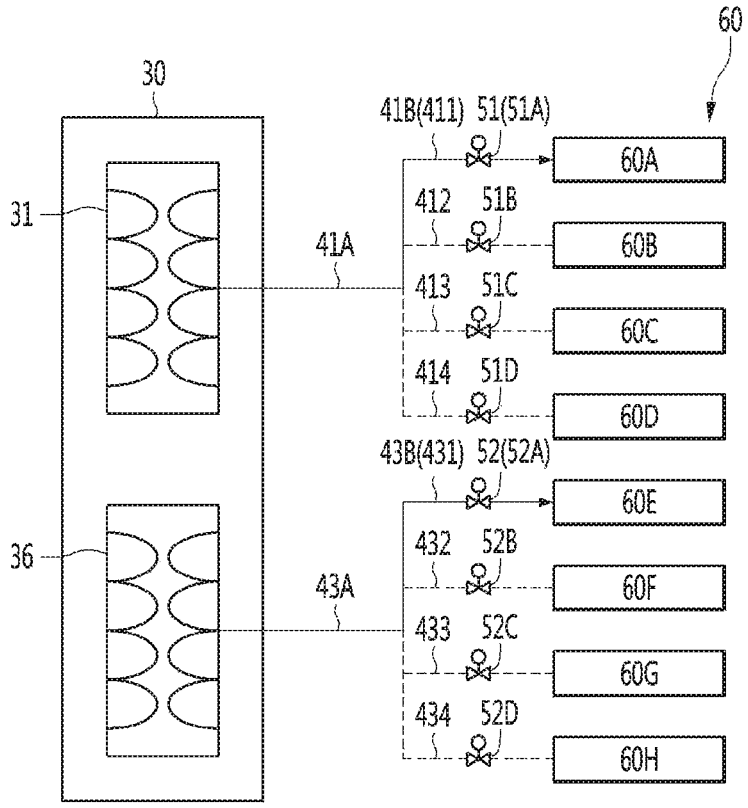
FIG. 6 is a view showing an example of a connection relationship between a distributor and a plurality of fan coil units illustrated in FIGS. 2 and 3.
Figure 7:
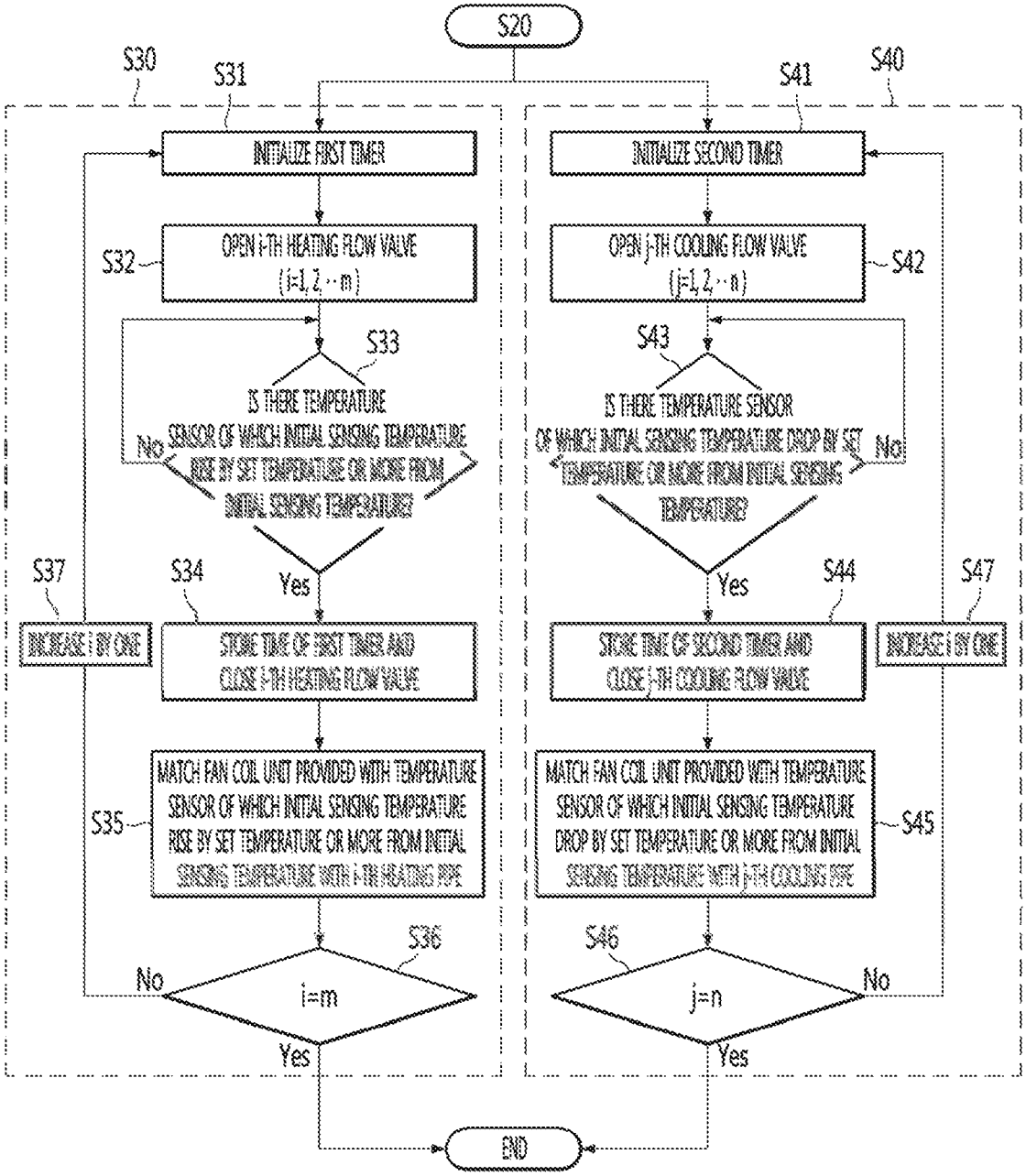
FIG. 7 is a flowchart illustrating a control sequence of a pipe search operation of an air conditioning system according to an embodiment of the present disclosure.

FIG. 6 is a view showing an example of a connection relationship between a distributor and a plurality of fan coil units illustrated in FIGS. 2 and 3, and FIG. 7 is a flowchart illustrating a control sequence of a pipe search operation of an air conditioning system according to an embodiment of the present disclosure.

The controller 90 may perform a pipe search operation S20. The pipe search operation may mean a process of matching a plurality of fan coil units with a plurality of connection pipes 41B and 43B. Some of the plurality of connection pipes 41B and 43B may be a heating pipe 41B and other some may be a cooling pipe 43B. The number of heating pipes 41B may be m (for example, m=4), and the number of cooling pipes 43B may n (for example, n=4). The sum of the number of heating pipes 41B and the number of cooling pipes 43B (m+n, for example, eight) may be equal to the number of fan coil units 60.

In more detail, unique unit numbers (for example, 1 to 8) may be respectively assigned to the plurality of fan coil units 60 in advance, and the unit numbers may be matched with the connection pipes 41B and 43B communicating with the fan coil units 60 via the pipe search operation S20.

Hereinafter, for convenience of description, a description will be given by taking, as an example, a four heating pipes 41B, four cooling pipes 43B, and eight fan coil units 60 are provided, and eight fan coils 60A, 60B, 60C, 60D, 60E, 60F, 60G and 60H shown in FIG. 6 are referred to as first fan coil unit 60A to eighth fan coil unit 60H in order from the top.

In addition, the four heating pipes 411, 412, 413 and 414 respectively communicating with the first fan coil units 60A to the fourth fan coil unit 60D are respectively referred to as the first heating pipe 411 to the fourth heating pipes 414 in order from the top. In addition, the four heating flow valves 51A, 51B, 51C and 51D respectively provided in the first heating pipe 411 to the fourth heating pipe 414 are respectively referred to as the first heating flow valve 51A to the fourth heating flow valve 51D in order from the top.

In addition, the four cooling pipes 431, 432, 433 and 434 respectively communicating with the fifth fan coil unit 60E to the eighth fan coil unit 60H are respectively referred to as the first cooling pipe 431 to the fourth cooling pipe 434 in order from the top. In addition, the four cooling flow valves 52A, 52B, 52C, and 52D respectively provided in the first cooling pipe 431 to the fourth cooling pipe 434 are referred to as the first cooling flow valve 52A to the fourth cooling flow valve 52D in order from the top.

The controller 90 may perform the heating pipe search operation S30 and the cooling pipe search operation S40 in parallel.

The heating pipe search operation S30 may refer to a process of matching some of the plurality of fan coil units 60 with the plurality of heating pipes 41B respectively, and the cooling pipe search operation S40 may refer to a process of matching some of the plurality of fan coil units 60 with the plurality of cooling pipes 43B respectively.

By performing the heating pipe search operation S30 and the cooling pipe search operation S40 in parallel, a pipe search speed may be about twice as fast than that in the case where all of the plurality of fan coil units 60 are sequentially matched with the connection pipes 41B and 43B.

Hereinafter, the heating pipe search 30 will be described in detail.

When the heating pipe search S30 is initiated, the controller 90 may initialize the first timer 81 (S31) and open the first heating flow valve 51A (S32). Initialization of the first timer 81 may mean that the first timer 81 starts at 0 seconds.

In this case, the first water pump 35 may be in an operating state, and the second, third, and fourth heating flow valves 51B, 51C, and 51D may be in a closed state.

Therefore, the hot water heated in the condenser 31 may flow through the first heating pipe 411 to the first fan coil unit 60A, and a sensing temperature of the temperature sensor 62 provided in the first fan coil unit 60A may gradually increase from an initial sensing temperature Ti by the hot water. On the other hand, since the water heated in the condenser 31 does not pass through the second, third and fourth heating pipes 412, 413 and 414, and the sensing temperatures of the temperature sensors 62 provided in the second, third and fourth fan coil units 60B, 60C and 60D may be unchanged or be changed very little compared to the initial sensing temperature Ti.

The controller 90 may determine whether there is a temperature sensor 62 of which the temperature rises by a set temperature (for example, 7 degrees) or more from the initial detection temperature Ti (S33). Therefore, when the sensing temperature of the temperature sensor 62 provided in the first fan coil unit 60A rises by the set temperature or more, from the initial sensing temperature Ti due to hot water, the controller 90 may detect the same.

Thereafter, the controller 90 may store the time of the first timer 81 in the storage unit 80 and close the first heating flow valve 51A (S34). In this case, the time stored in the storage unit 80 may be a search time T1 required for matching of the first heating pipe 51A.

In addition, the controller 90 may match the fan coil unit 60 with the temperature sensor 62 of which the temperature raises to the set temperature or more from the initial sensing temperature Ti with the first heating pipe 411 (S35). That is, since the controller 90 has detected that the temperature of the temperature sensor 62 provided in the first fan coil unit 60A raises to the set temperature or more from the initial sensing temperature Ti, the controller 90 may match the first fan coil unit 60A with the first heating pipe 411. As a result, matching of the first heating pipe 411 may be completed.

Thereafter, the controller 90 may perform matching of the next heating pipe (S36)(S37). That is, the controller 90 may sequentially perform matchings of the second, third, and fourth heating pipes 412, 413, and 414. Those skilled in the art will also readily understand the matching processes of the second, third and fourth heating pipes 412, 413, 414 from the description of the matching process of the first heating pipe 411 described above.

Accordingly, the second heating pipe 412 may be matched with the second fan coil unit 60B, the third heating pipe 413 may be matched with the third fan coil unit 60C, and the fourth heating pipe 414 may be matched with the fourth fan coil unit 60D. In addition, the storage unit 80 may store search times T2, T3, and T4 required for matchings of the second, third, and fourth heating pipes 412, 413 and 414.

Hereinafter, the cooling pipe search operation (S40) will be described in detail.

When the cooling pipe search operation S40 is initiated, the controller 90 may initialize the second timer 82 (S41) and open the first cooling flow valve 52A (S42). Initialization of the second timer 82 may mean that the second timer 82 starts at 0 seconds.

In this case, the second water pump 40 may be in an operating state, and the second, third, and fourth cooling flow valves 52B, 52C, and 52D may be in a closed state.

Accordingly, the cold water cooled in the evaporator 431 may flow through the first cooling pipe 431 to the fifth fan coil unit 60E, and a sensing temperature of the temperature sensor 62 provided in the fifth fan coil unit 60E may gradually drop from an initial sensing temperature Ti by the cold water. On the other hand, since the cold water cooled in the evaporator 36 cannot pass through the second, third and fourth cooling pipes 432, 433 and 434, the sensing temperatures of the temperature sensors 62 provided in the sixth, seventh and eighth fan coil units 60F, 60G and 60H may be unchanged or be changed very little compared to the initial sensing temperature Ti.

The controller 90 may determine whether there is a temperature sensor 62 of which the temperature drops by a set temperature (for example, 7 degrees) or more from the initial detection temperature Ti (S43). Therefore, when the sensing temperature of the temperature sensor 62 provided in the fifth fan coil unit 60E rises by the set temperature or more, from the initial sensing temperature Ti due to cold water, the controller 90 may detect the same.

Thereafter, the controller 90 may store the time of the second timer 82 in the storage unit 80 and close the first cooling flow valve 52A (S44). In this case, the time stored in the storage unit 80 may be a search time T5 required for matching of the first cooling pipe 52A.

In addition, the controller 90 may match the fan coil unit 60 with the temperature sensor 62 of which the temperature drops by the set temperature or more from the initial sensing temperature Ti with the first cooling pipe 431 (S45). That is, since the controller 90 has detected that the temperature of the temperature sensor 62 provided in the fifth fan coil unit 60E drops by the set temperature or more from the initial sensing temperature Ti, the controller 90 may match the fifth fan coil unit 60E with the first cooling pipe 431. Thus, matching of the first cooling pipe 431 may be completed.

Thereafter, the controller 90 may perform matching of the next cooling pipe (S46)(S47). That is, the controller 90 may sequentially perform matchings of the second, third and fourth cooling pipes 432, 433 and 434. Those skilled in the art will also readily understand the matching processes of the second, third and fourth cooling pipes 432, 433 and 434 from the description of the matching process of the first cooling pipe 431 described above.

As a result, the second cooling pipe 432 may be matched with the sixth fan coil unit 60F, the third cooling pipe 433 may be matched with the seventh fan coil unit 60G, and the fourth cooling pipe 434 may be matched with the eighth fan coil unit 60H. In addition, the storage unit 80 may store search times T6, T7, and T8 required for matching of the second, third, and fourth cooling pipes 432, 433, and 434.

When the matching of all the heating pipes 411, 412, 413, and 414 and the cooling pipes 431, 432, 433 and 434 is completed, the controller 90 may end the pipe search operation S20.

Figure 8:
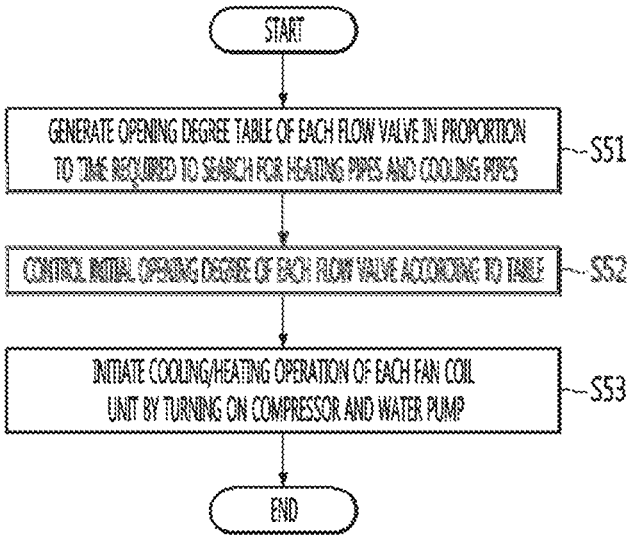
FIG. 8 is a flowchart illustrating a control procedure when operation of fan coil units is initiated after pipe search operation.

FIG. 8 is a flowchart illustrating a control procedure when operation of fan coil units is initiated after pipe search operation.

In the cooling and heating operation of the fan coil units 60 after the pipe search operation, the controller 90 may perform feed forward control by using the search time of each of the connection pipes 41B and 43B stored in the storage unit 80 during the pipe search operation S20 described above. That is, the controller 90 may consider a change in the cooling and heating performance due to a loss in the pipe pressure in each of the connection pipes 41B and 43B in advance, and control an initial opening degree (Oi) of each of the flow valves 51 and 52 corresponding to the length of each of the connection pipes 41B and 43B, enhancing operation efficiency of the air conditioning system.

The relatively long search time of any one of the connection pipes 51 and 52 may mean that the length of the corresponding connection pipe 51 of 52 is relatively long and therefore, a loss in pressure of water flowing into the fan coil unit 60 connected to the corresponding connection pipe 51 or 52 is large. That is, the cooling and heating operation performance of the fan coil unit 60 connected to the corresponding connection pipe 51 or 52 may be degraded. In order to compensate for such performance degradation, the controller 90 may perform the feed forward control as described above, so that the connection pipe 51 or 52 having a long search time is supplied with a relatively large amount of water, and the connection pipe 51 or 52 having a short search time may be supplied with relatively small amount of water. As a result, excessive or insufficient air conditioning performance of each fan coil unit 60 can be prevented, and the overall efficiency of the air conditioning system can be improved. In addition, since the flow rate control of each fan coil unit 60 can be performed using the optimized initial opening degree Oi as a set point, air-cooling and air-heating in a room where the fan coil unit 60 is installed can be quickly performed compared to the prior art.

Hereinafter, the feed forward control will be described in more detail.

In more detail, the controller 90 may generate an opening degree table for each of the flow valves 51 and 52 in proportion to the search times T1 to T8 spent for search for the heating pipe 41B and the cooling pipe 43B (S51). An initial opening degree Oi corresponding to each of the flow valves 51 and 52 may be set in the table, and the table may be stored in the storage unit 80.

The initial opening degree Oi of the flow valve 51 or 52 provided in the connection pipe 41B or 43B having a relatively long search time T1 to T8 may be relatively large, and the initial opening degree Oi of the flow valve 51 or 52 provided in the connection pipe 41B or 43B having a relatively short search time T1 to T8 may be relatively small. The initial opening degree Oi of the flow valve installed in the connection pipe with the longest search time T1 to T8 among the plurality of flow valves 51 and 52 is full open, and the remaining flow valves may have initial opening degrees Oi determined in proportion to each search time based on the fully-opened flow valve.

For example, the search times T1 to T4 of the first, second, third, and fourth heating pipes 411, 412, 413 and 414 are 450 seconds, 900 seconds, 675 seconds, and 225 seconds, respectively and the search times T5 to T8 of the first, second, third, and fourth cooling pipes 431, 432, 433, and 434 are 90 seconds, 180 seconds, 450 seconds, and 45 seconds, respectively, the longest search time is 900 seconds and a corresponding flow valve is the second heating flow valve 51B. In this case, the initial opening degrees Oi of the first, second, third and fourth heating flow valves 51A, 51B, 51C, and 51D are 50%, 100% (full open), 75%, and 25%, respectively. The initial opening degrees Oi of the first, second, third, and fourth cooling flow valves 52A, 52B, 52C, and 52D may be determined as 10%, 20%, 50%, and 5%, respectively.

Thereafter, the controller 90 may control the initial opening degree Oi of each of the flow valves 51 and 52 according to the table stored in the storage unit 80 (S52). In more detail, when the cooling and heating operation of each fan coil unit is initiated, the controller 90 may control the initial opening degree Oi of each of the flow valves 51 and 52 according to the table stored in the storage unit 80.

Subsequently, the controller 90 may initiate the cooling and heating operation of each fan coil unit 60 by turning on of the compressor 11 of the outdoor unit 10 and the water pumps 35 and 40 of the distributor 30. In this case, the controller 90 may perform fuzzy control on the opening degrees of the flow valves 51 and 52 based on the initial opening degrees Oi of the flow valve 51 and 52, and allow each fan coil unit 60 to perform cooing and heating operation. Since fuzzy control is a well-known technique, detailed description thereof will be omitted.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary embodiments of the present disclosure are provided to explain the spirit and scope of the present disclosure, but not to limit them, so that the spirit and scope of the present disclosure is not limited by the embodiments.

The scope of the present disclosure should be construed on the basis of the accompanying claims, and all the technical ideas within the scope equivalent to the claims should be included in the scope of the present disclosure.

The invention claimed is:

1. An air conditioning system, comprising:

an outdoor unit including a compressor;

at least one distributor connected to the outdoor unit and including a condenser and an evaporator that exchange heat between refrigerant and water;

a plurality of heating pipes in communication with the condenser;

a plurality of cooling pipes in communication with the evaporator;

a plurality of fan coil units connected to the plurality of heating pipes or the plurality of cooling pipes; and a controller configured to perform a heating pipe search operation for respectively matching a portion of the plurality of fan coil units with the plurality of heating pipes, and a cooling pipe search operation for respectively matching another portion of the plurality of fan coil units with the plurality of cooling pipes;

a plurality of temperature sensors respectively provided in the plurality of fan coil units;

a plurality of heating flow valves respectively installed in the plurality of heating pipes;

a plurality of cooling flow valves respectively installed in the plurality of cooling pipes, wherein the controller is configured to, after any one of the plurality of heating flow valves is opened, match a fan coil unit provided with a temperature sensor a sensed temperature of which rises by a set temperature or more among the plurality of temperature sensors with a heating pipe provided with the any one heating flow valve, and after any one of the plurality of cooling flow valves is opened, match a fan coil unit provided with a temperature sensor a sensed temperature of which drops by a set temperature or more among the plurality of temperature sensors with a cooling pipe provided with the any one cooling flow valve;

a first timer configured to measure search times respectively required for matching of the plurality of heating pipes;

a second timer configured to measure search times respectively required for matching of the plurality of cooling pipes; and a storage unit configured to store search times measured by the first timer and the second timer.

2. The air conditioning system of claim 1, wherein the controller is configured to:

turn on the compressor when a pipe search command is input to an input unit, and initiate the heating pipe search operation and the cooling pipe search operation when a predetermined set time has elapsed after the compressor is turned on or when a high pressure of the compressor reaches a predetermined set pressure or more.

3. The air conditioning system of claim 1, wherein the storage unit is configured to store initial sensing temperatures of the plurality of temperature sensors before the heating pipe search operation and the cooling pipe search operation are performed.

4. The air conditioning system of claim 1, wherein the controller is configured to:

control an initial opening ° of a heating flow valve installed in a heating pipe with a relatively long search time to be larger than an initial opening ° of a heating flow valve installed in a heating pipe with a relatively short search time when operation of a fan coil unit connected to the heating pipe is initiated after the heating pipe search operation and the cooling pipe search operation are completed, and control an initial opening ° of a cooling flow valve installed in a cooling pipe with a relatively long search time to be larger than an initial opening ° of a cooling flow valve installed in a cooling pipe with a relatively short search time when operation of a fan coil unit connected to the cooling pipe is initiated after the heating pipe search operation and the cooling pipe search operation are completed.

5. An air conditioning system, comprising:

an outdoor unit including a compressor;

at least one distributor connected to the outdoor unit and including a condenser and an evaporator that exchange heat between refrigerant and water;

a plurality of connection pipes in communication with the condenser or evaporator;

a plurality of flow valves respectively installed in the plurality of connection pipes;

a plurality of fan coil units connected to the connection pipes;

a controller configured to perform a pipe search operation for matching the plurality of connection pipes with the plurality of fan coil units, respectively;

a timer configured to measure search times respectively required for matching of the plurality of connection pipes; and a storage unit configured to store the search times, wherein the controller is configured to control an initial opening degree of a flow valve installed in a connection pipe with a relatively long search time to be larger than an initial opening degree of a flow valve installed in a connection pipe with a relatively short search time when operation of the fan coil units is initiated after the pipe search operation is completed.

6. The air conditioning system of claim 5, wherein the controller is configured to fully open an initial opening degree of a flow valve installed in a connection pipe with a longest search time among the plurality of flow valves when the operation of the fan coil units is initiated after the pipe search operation is completed.

* * * * *